US005598653A

United States Patent [19]

Schaefer

[11] Patent Number: 5,598,653

[45] Date of Patent: Feb. 4, 1997

[54] RETRACTABLE SIGNAGE DEVICE

[75] Inventor: Joyce E. Schaefer, Indianapolis, Ind.

[73] Assignee: The Schaefer Group, Las Vegas, Nev.

[21] Appl. No.: 395,087

[22] Filed: Feb. 27, 1995

[51] Int. Cl.[6] ..... G09F 21/04

[52] U.S. Cl. ..... 40/593; 40/606; 40/492; 248/292.13

[58] Field of Search ..... 40/492, 533, 591, 40/593, 606, 643, 610; 116/51, 28 R; 248/205.3, 291.1, 292.13

[56] References Cited

U.S. PATENT DOCUMENTS

| | | | |
|---|---|---|---|
| D. 234,592 | 3/1975 | Callaway . | |
| D. 297,926 | 10/1988 | Kesler . | |
| D. 340,903 | 11/1993 | Wayne . | |
| 1,527,704 | 2/1925 | Ray | 40/492 |
| 1,621,882 | 3/1927 | Hodgson . | |
| 1,776,447 | 9/1930 | Parkhurst | 40/610 X |
| 1,909,362 | 5/1933 | Keith . | |
| 2,182,275 | 12/1939 | Blonkvist . | |
| 2,659,486 | 11/1953 | Krupin | 40/492 X |
| 2,671,977 | 3/1954 | Lingard . | |
| 2,706,806 | 4/1955 | Johnson . | |
| 2,990,637 | 7/1961 | Saben . | |
| 3,141,253 | 7/1964 | Bartram | 40/593 |
| 3,237,330 | 3/1966 | Dinstbir . | |
| 3,508,356 | 4/1970 | Ross . | |
| 4,069,606 | 1/1978 | Shevin et al. . | |
| 4,251,719 | 2/1981 | Ryder | 40/492 X |
| 4,674,212 | 6/1987 | Snodgrass . | |
| 4,909,178 | 3/1990 | Le Brocq . | |
| 5,133,141 | 7/1992 | Bane . | |
| 5,230,174 | 7/1993 | Reed | 40/492 |

FOREIGN PATENT DOCUMENTS

| | | | |
|---|---|---|---|
| 2218632 | 10/1973 | Germany | 40/591 |

*Primary Examiner*—Brian K. Green
*Attorney, Agent, or Firm*—Locke Reynolds

[57] ABSTRACT

A retractable signage device attachable to a rearview mirror of a vehicle or vessel is disclosed for indicating to the occupants that a certain important condition exists. A housing and flexible strap are attached to the non-reflective portion of the rearview mirror, and an arm having a signage portion is rotatably attached to the housing and strap. The arm may be disposed in a retracted postion where the signage portion is substantially unobservable to the occupants, or in an actuated position where the signage portion is generally parallel with and proximate to the reflective portion of the rearview mirror.

4 Claims, 3 Drawing Sheets

RETRACTABLE SIGNAGE DEVICE

BACKGROUND OF THE INVENTION

1. Field of the Invention

The present invention generally relates to signage devices used in vehicles and vessels, and more particularly concerns retractable signage devices that are capable of attachment to the rearview mirror of a vehicle or vessel to indicate to the occupants that a certain condition or situation exists to which prompt attention should be given.

2. Description of the Prior Art

The array of signage devices that may be used to indicate to the occupants of a vehicle or vessel that a certain important situation exists ranges from free-standing devices that may be attached to various portions of the vehicle or vessel, such as those described in U.S. Pat. Nos. 2,706,806, 3,237,330, 3,508,356, 4,069,606 and 4,909,178, to those devices that are attachable to seat belts, such as that described by U.S. Pat. No. 4,674,212, or to steering wheels, such as that described by U.S. Pat. No. 1,621,882.

In addition, a number of such signage devices that may be attached to or supported from the rearview mirror of a vehicle or vessel are presently available, for instance, the devices of U.S. Pat. Nos. 2,671,977, 2,990,637, and Des. No. 234,592. However, these devices may not be easily retracted or otherwise removed from view, with the result that the continuous display of the sign eventually lessens the desired effect, that is, the occupants of the vehicle or vessel cease to pay particular attention to the sign. As a result, the intended effect of causing the occupants to be aware of a special situation or condition is not achieved.

Also, a number of signage devices integral with a rearview mirror are presently available, for instance, the device of U.S. Pat. No. 1,909,361 where a rearview mirror is flipped up to an inoperative position to allow a signage element to become visible, and the device of U.S. Pat. No. 2,182,275 where a multiplicity of signs are sequentially displayed adjacent to the rearview mirror.

Despite the availability of such devices, there exists a need in the prior art for a signage device that is capable of easy attachment to existing rearview mirrors commonly found on a variety of vehicles and vessels in order to remind the occupants of a certain condition or situation, yet does not block or obscure the view of the occupants when in use, and may be retracted out of sight when not in use.

SUMMARY OF THE INVENTION

In order to aid in the understanding of the present invention, it can be stated in essentially summary form that it is directed to a retractable signage device that is capable of attachment to the rearview mirror of a vehicle or vessel, and may be placed in an actuated position where a sign portion of the present invention is visible to the occupants of the vehicle or vessel, or placed in a retracted position where the present invention is substantially out of the sight of the occupants of the vehicle or vessel.

It is an object of the present invention to provide a retractable signage device that is capable of attachment to the rearview mirror of a wide variety of vehicles, vessels, and the like.

It is another object of the present invention to provide a retractable signage device that is large enough to be easily read, yet does not significantly obscure the view of the occupants of the user.

It is another object of the present invention to provide a retractable signage device that may be placed in a retracted position where the present invention is substantially removed from the view of the user.

It is another object of the present invention to provide a retractable signage device that is capable of attachment to a rearview mirror of a vehicle or vessel at the time of manufacture of the rearview mirror or as an aftermarket accessory.

It is still another object of the present invention to provide a retractable signage device that is inexpensive to produce.

It is yet another object of the present invention to provide a retractable signage device of relatively simple construction with a minimum number of components.

Further objects and advantages of the present invention will be apparent from a study of the following portion of the specification, the claims, and the attached drawings.

DESCRIPTION OF THE PREFERRED EMBODIMENT

The following portion of the specification, taken in conjunction with the drawings, sets forth the preferred embodiment of the present invention. The embodiment of the invention disclosed herein is the best mode contemplated by the inventors for carrying out their invention in a commercial environment, although it should be understood that various modifications can be accomplished within the parameters of the present invention.

Figure 1:
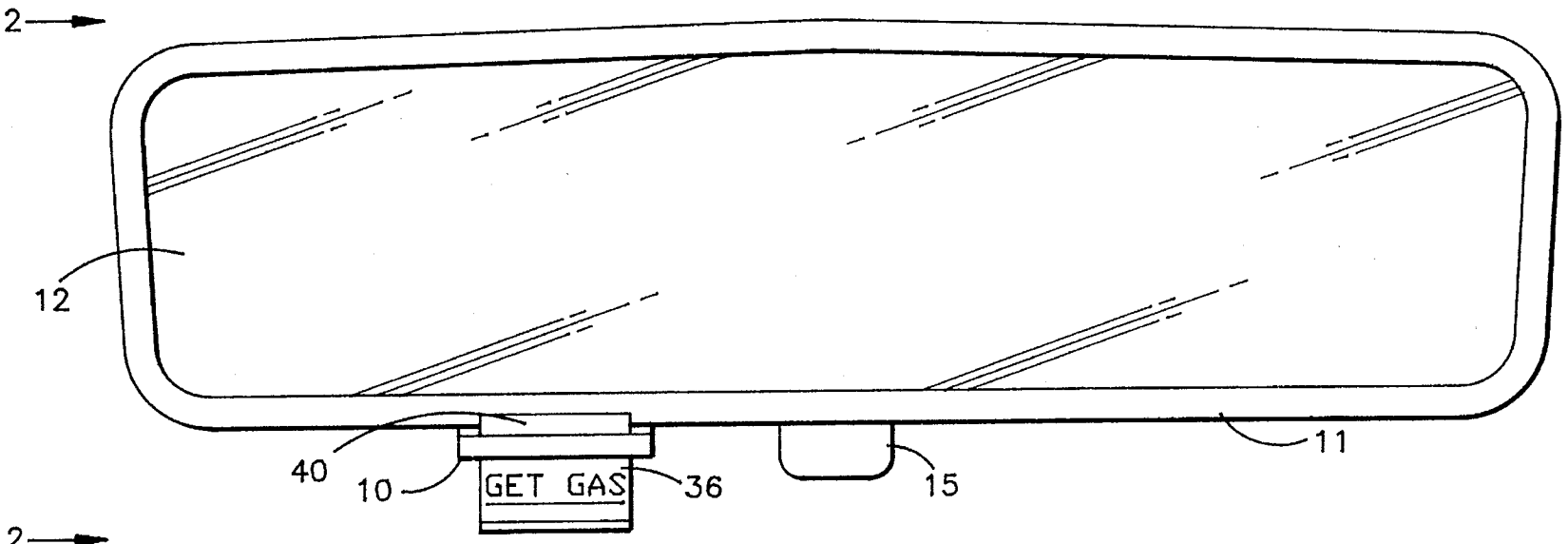
FIG. 1 is a front elevation view of a retractable signage device representing the present invention in the actuated position as attached to a rearview mirror.
Figure 2:
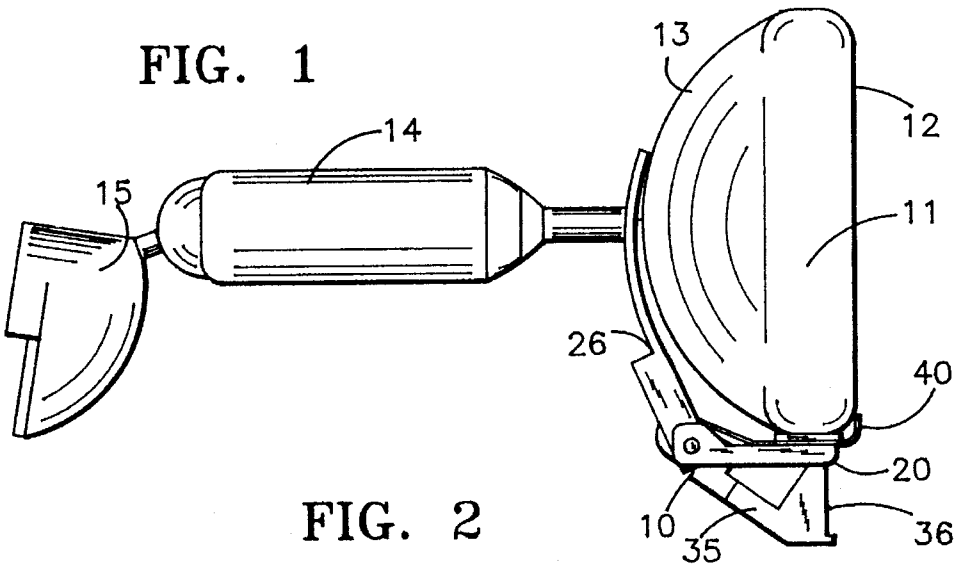
FIG. 2 is a side elevation view of a retractable signage device representing the present invention in the actuated position as attached to a rearview mirror.
Figure 3:
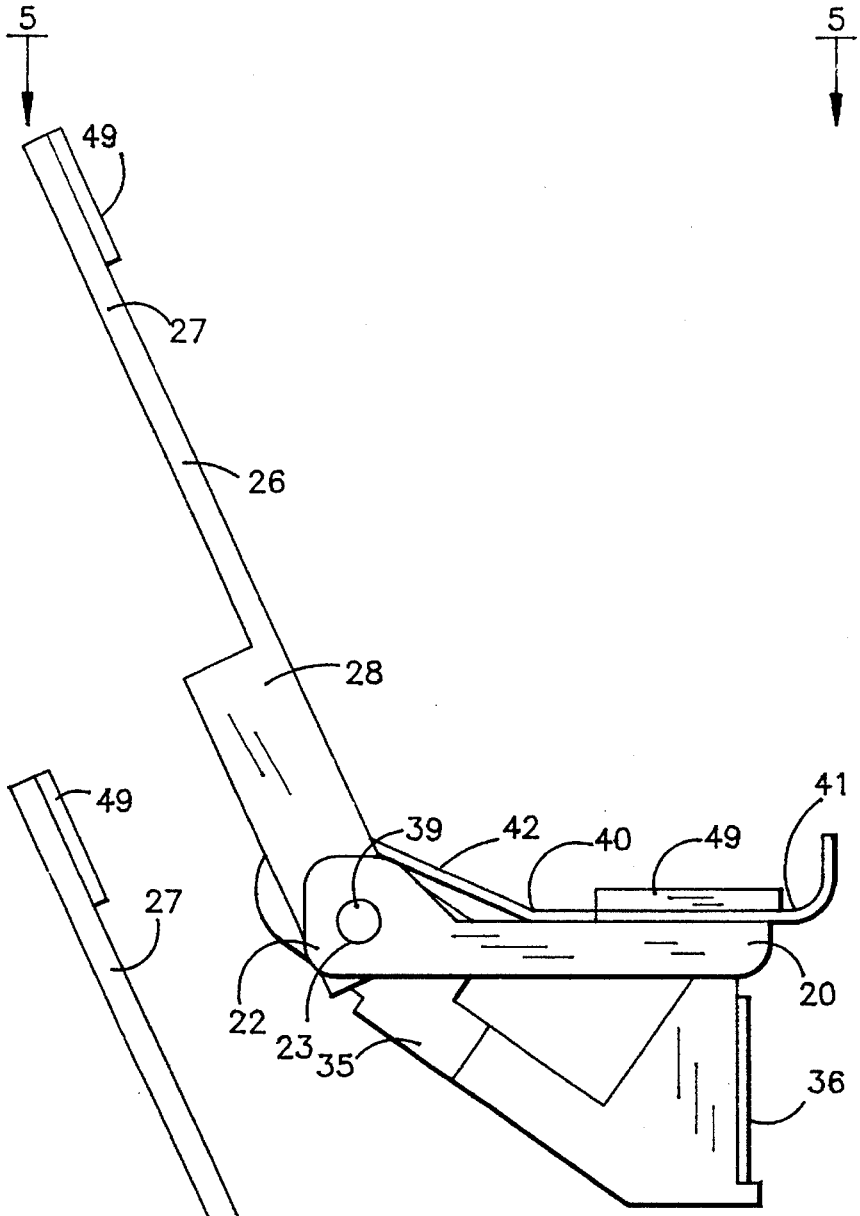
FIG. 3 is a detail side view of a retractable signage device representing the present invention in the actuated position.
Figure 4:
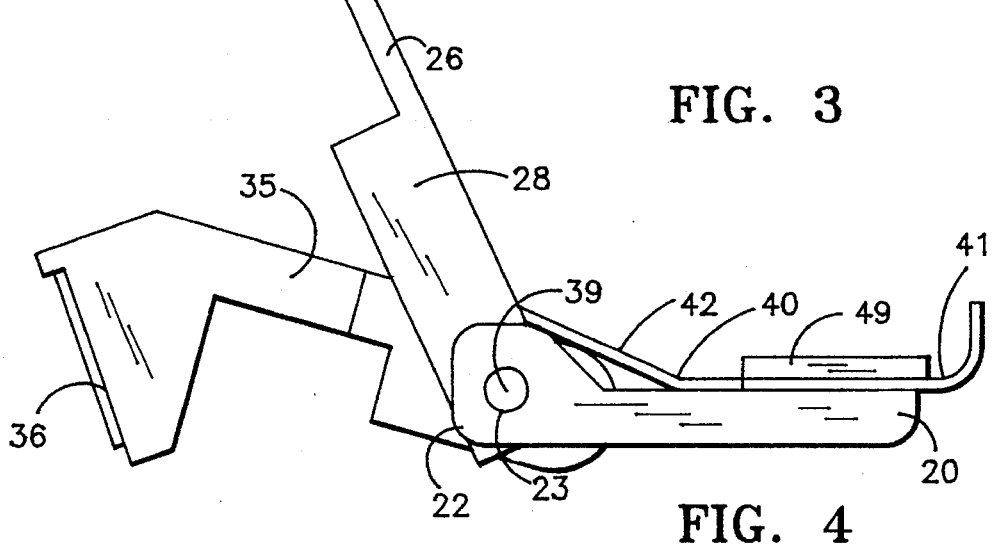
FIG. 4 is a detail side view of a retractable signage device representing the present invention in the retracted position.
Figure 5:
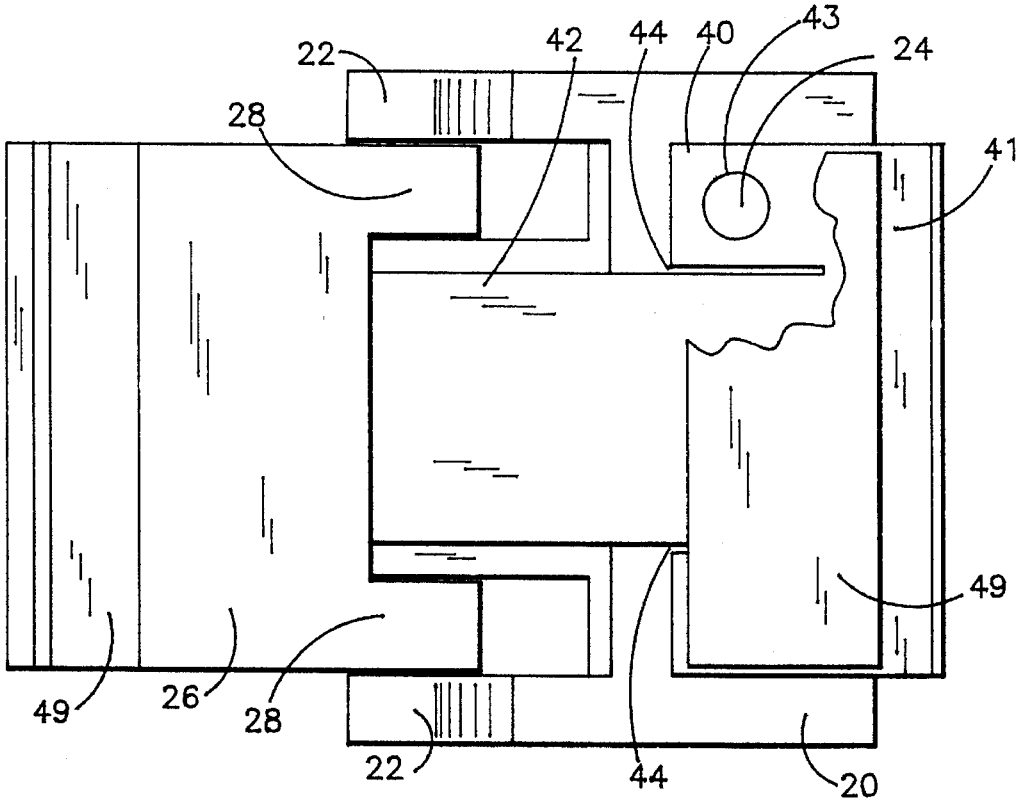
FIG. 5 is a detail top view with partial cut-away of a retractable signage device representing the present invention in the actuated position.
Figure 6:
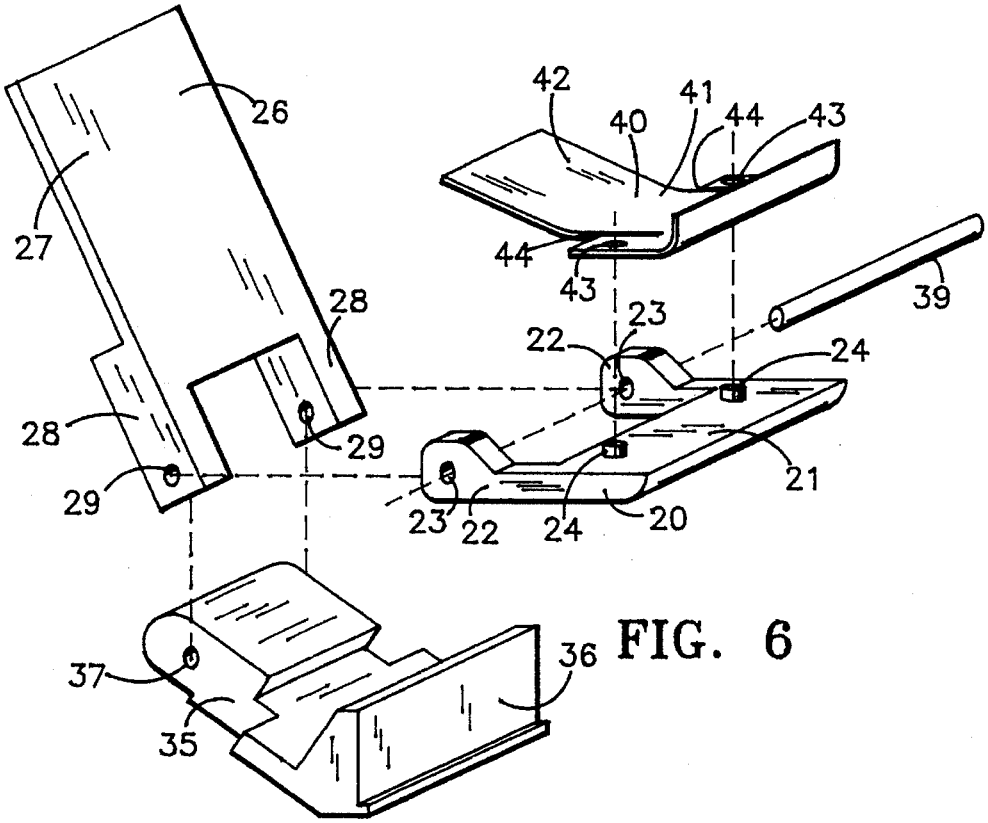
FIG. 6 is an exploded perspective view of a portion of retractable signage device representing the present invention.

Referring now to the drawings for a detailed description of the present invention, reference is first made to FIGS. 1 and 2, depicting retractable sign 10 disposed in attachment to automobile rearview mirror 11 having planar reflective surface 12, non-reflective surface 13, neck 14 and windshield attachment bracket 15.

As shown in FIGS. 3, 4, 5, and 6, housing 20 has central portion 21, a pair of parallel housing arms 22, housing bore 23, and a pair of mounting pins 24. Housing arms 22 are disposed coplanar with and projecting from central portion 21, and housing bore 23 is disposed normally through housing arms 22, distal to central portion 21. Flexible strap 26 has main portion 27, a pair of parallel strap arms 28, and strap bore 29, with strap arms 28 disposed coplanar with and projecting from main portion 27, and strap bore 29 disposed normally through strap arms 28 and distal to main portion 27. Housing bore 23 and strap bore 29 are colinearly disposed, and strap arms 28 are disposed within housing arms 22.

Also as depicted in FIGS. 3, 4, 5, and 6, arm 35 has generally planar signage portion 36 and arm bore 37, with the dimensions of arm 35 proximate to arm bore 37 chosen so that arm 35 may be disposed between strap arms 28 with arm bore colinear with strap bore 29. Pin 39 is disposed through housing bore 23, strap bore 29, and arm bore 37, rotatably attaching strap 26 to housing 20, and rotatably attaching arm 35 to housing 20 and strap 26. In this way, arm 35 may be rotated with respect to housing 20 between a retracted, first position shown in FIG. 4, where signage portion 36 is disposed proximate to non-reflective portion 13, and an actuated, second position shown in FIGS. 1, 2, and 3, where signage portion 36 is disposed with and proximate to reflective surface 12. In addition, strap 26 may be rotated with respect to housing 20, so that the present invention may be adapted to mount to a variety of rearview mirrors having different shapes and dimensions of non-reflective surface 13. Leaf spring 40 has body portion 41, lever portion 42, a pair of mounting holes 43 and a pair of parallel slits 44. Leaf spring 40 is attached to central portion 21 by heat staking mounting pins 24 subsequent to insertion of mounting pins 24 through mounting holes 43, with lever portion 42 disposed adjacent to and bearing against arm 35. As so disposed, leaf spring 40 urges arm 35 towards the first position when arm 35 is disposed proximate to the first position, and urges arm 35 towards the second position when arm 35 is disposed proximate to the second position.

In use, housing 20, strap 26, and leaf spring 40 are attached to non-reflective surface 13 by a suitable adhesive, for instance, by double-backed adhesive tape 49. The present invention is thus attached to rearview mirror 11 by positioning housing 20 and strap 26 proximate to non-reflective surface 13, and applying pressure as tape 49 comes into contact with non-reflective surface 13. The flexible nature of strap arm 26 permits strap arm 26 to conform to the shape of various rearview mirrors. Normally, signage portion 36 is disposed proximate to non-reflective portion 13 in the retracted, first position, with leaf spring 40 bearing against arm 35. In the first position, signage portion 36 is substantially out of the view of the occupants of the vehicle or vessel. When it is determined that a certain important condition exists, for example, that the vehicle or vessel is in need of fuel, signage portion 36 is rotated to the actuated, second position, with leaf spring 40 again bearing against arm 35. In the second position, signage portion 36 is disposed coplanar with and proximate to reflective surface 12, so that the occupants of the vehicle or vessel may readily observe signage portion 36.

The present invention having been described in its preferred embodiment, it is clear that it is susceptible to numerous modifications and embodiments within the ability of those skilled in the art and without the exercise of the inventive faculty. Accordingly, the scope of the present invention is defined by the scope of the following claims.

What is claimed is:

1. A retractable sign for a rearview mirror having a planar reflective surface and a non-reflective surface, comprising:

a housing;

means for attaching said housing to said non-reflective surface;

a flexible strap;

means for attaching said strap to said non-reflective surface;

an arm having a generally planar signage portion;

means for attaching said arm to said housing and said strap so that said arm may be rotated with respect to said housing between a retracted first position where said signage portion is disposed proximate to said non-reflective surface and an actuated second position where said signage portion is disposed coplanar with and proximate to said reflective surface; and a spring means attached to said housing and bearing against said arm so that said arm is urged towards said first position when said arm is disposed proximate to said first position and said arm is urged towards said second position when said arm is disposed proximate to said second position.

2. A retractable sign for a rearview mirror as defined in claim 1, wherein said means for attaching said housing to said non-reflective surface and said means for attaching said strap to said non-reflective surface comprises attachment by disposing adhesive between said housing and said non-reflective surface and between said strap and said non-reflective surface.

3. A retractable sign for an automobile rearview mirror having a planar reflective surface and a non-reflective surface comprising:

a housing having a central portion, a pair of parallel housing arms, and a housing bore, said housing arms disposed coplanar with and projecting from said central portion, and said housing bore disposed normally through said housing arms and distal to said central portion;

a flexible strap having a main portion, a pair of parallel strap arms, and a strap bore, said strap arms disposed coplanar with and projecting from said main portion, and said strap bore disposed normally through said strap arms and distal to said main portion;

means for attaching said housing and said strap to said non-reflective surface so that said housing bore and said strap bore are colinear;

an arm having a generally planar signage portion and an arm bore;

a pin, disposed through said housing bore, said strap bore, and said arm bore, rotatably attaching said strap to said housing, and rotatably attaching said arm to said housing and said strap so that said arm may be rotated with respect to said housing between a retracted, first position where said signage portion is disposed proximate to said non-reflective portion and an actuated, second position where said signage portion is disposed coplanar with and proximate to said reflective surface;

a leaf spring having a body portion and a lever portion; and means for attaching said body portion to said central portion so that said lever portion is disposed adjacent to and bears against said arm, and said leaf spring urges said arm towards said first position when said arm is disposed proximate to said first position and urges said arm towards said second position when said arm is disposed proximate to said second position.

4. A retractable sign for a rearview mirror as defined in claim 3, wherein said means for attaching said housing and said strap to said non-reflective surface comprises attachment by disposing adhesive between said housing and said non-reflective surface and between said strap and said non-reflective surface.

* * * * *